United States Patent [19]

Vondra et al.

[11] 4,244,157

[45] Jan. 13, 1981

[54] COIN COUNTER AND WRAPPER FILLER

[76] Inventors: Robert A. Vondra, 5638 Spring St., Omaha, Nebr. 68106; Richard E. McGuire, 1013 N. 90th St. - Apt. 1, Omaha, Nebr. 68114

[21] Appl. No.: 7,343

[22] Filed: Jan. 29, 1979

[51] Int. Cl.[3] ..... B65B 39/00; B65B 39/06

[52] U.S. Cl. ..... 53/254; 53/390; 133/1 A; 133/8 R

[58] Field of Search ..... 53/254, 390, 532; 133/6 A, 8 A, 8 R

[56] References Cited

U.S. PATENT DOCUMENTS

| | | | |
|---|---|---|---|
| 961,832 | 6/1910 | Ayres, Jr. | 53/254 |
| 1,407,140 | 2/1922 | Friesen | 133/1 A |
| 1,710,086 | 4/1929 | Downey | 53/254 |
| 2,150,473 | 3/1939 | Wagner | 53/254 |
| 2,530,009 | 11/1950 | Fields | 133/8 R X |
| 2,996,864 | 8/1961 | Cook | 53/254 |
| 3,180,070 | 4/1965 | Arsen | 53/254 |
| 3,206,914 | 9/1965 | Norris | 53/254 |
| 3,999,563 | 12/1976 | Frias, Jr. | 133/8 R |
| 4,091,599 | 5/1978 | Lemieux | 53/254 |

FOREIGN PATENT DOCUMENTS

| | | | |
|---|---|---|---|
| 65363 | 12/1913 | Fed. Rep. of Germany | 53/254 |
| 91179 | 1/1938 | Sweden | 133/1 A |

*Primary Examiner*—Horace M. Culver
*Attorney, Agent, or Firm*—Hiram A. Sturges

[57] ABSTRACT

A coin counter and wrapper filler comprising a body having a hollow shank receiving coins, the lower end of the shank being tapered inwardly for reception in the upper end of a cylindrical paper coin wrapper, said body having a funnel attached at its upper end, said body having visibility means so that the quantity of coins inside the tank can be read against indicia printed on the shank, and a plug having a lower end extending across and engaging the lower end of the shank, the plug having an upper end portion of resilient nature which resiliently and removably grips the lower end of the shank, whereby the plug can be removed after coin counting for permitting coins to fall into the open top of a closed coin wrapper.

1 Claim, 4 Drawing Figures

COIN COUNTER AND WRAPPER FILLER

BACKGROUND OF THE INVENTION

This invention is in the field of coin counters and in the general field of coin wrapping such as is done at businesses and banks for the storage of coins of known quantity in wrappers.

In past years there have been many proposals for the using of a hollow tube for receiving coins, such tubes having indicia on the side to indicate the number of coins in a tube. A funnel at the top of such a tube has been proposed.

However, to our knowledge there has never been a counting tube with a funnel at its top end and with an easily and quickly removable plug at the bottom end. We propose such a plug so that the bottom end of the tube can be inserted into the open top of a cylindrical coin wrapper for emptying into the wrapper an exact number of counted coins. We consider that it is important that the plug seal off the interior of the hollow shank at a precise position for upholding the lowermost coin in a stack so that upper coins register with the indicia on the shank.

We are aware of a U.S. Pat. No. 1,110,174 issued to E. Zander, titled: "COIN TUBE" issued Sept. 8, 1914. This patent has a cap at the bottom, but is without any teaching concerning its removability. We presume it was permanently attached to stay in place.

We are aware of a U.S. Pat. No. 2,150,473, issued to A. N. Wagner, Mar. 14, 1939, titled, DEVICE FOR FILLING COIN WRAPPERS WITH COINS. It does have a plug, but not in the bottom of a coin counting tube, but instead at the bottom of a coin folder.

Also we propose that the weak and wobbly wrapper not be a structural member of the counter, but instead to be stretched from its flat nature to its cylindrical nature by a tapered lower end of the counting shank, whereby the folder need not hold a cylindrical shape until such time as the coins themselves fill it and give it shape-holding capacity.

We are also aware of many other patents, all of which have permanent bottom wall means, fixed to the tubular shank.

To our knowledge, no earlier patents on coin counters propose that coins be emptied from the lower end of a hollow shank into a coin wrapper.

Because it is desirable to make the shank out of plastic materials which have a substantial thickness in order to be strong, it is one of the concepts of our invention to provide for an inward tapering of the lower end of the hollow shank for easier reception in the upper end of a coin wrapper tube.

We conceive that the various coin counters of progressively smaller size coins could be stored with the smaller hollow shanks nested in progressively larger hollow shanks of counters for the larger coins.

SUMMARY OF THE INVENTION

The major goal of this invention is to provide a coin counter and wrapper filler comprising a body having a hollow shank receiving coins, the lower end of the shank being tapered inwardly for reception in the upper end of a cylindrical paper coin wrapper, said body having a funnel attached to its upper end, said body having visibility means so that the quantity of coins inside the tank can be read against indicia printed on the shank, and a plug having a lower end and extending across and engaging the lower end of the shank, the plug having an upper end portion of resilient nature which resiliently and removably grips the lower end of the shank, whereby the plug can be removed after coin counting for permitting coins to fall into the open top of a closed coin wrapper.

DESCRIPTION OF THE PREFERRED EMBODIMENT

Figure 1:
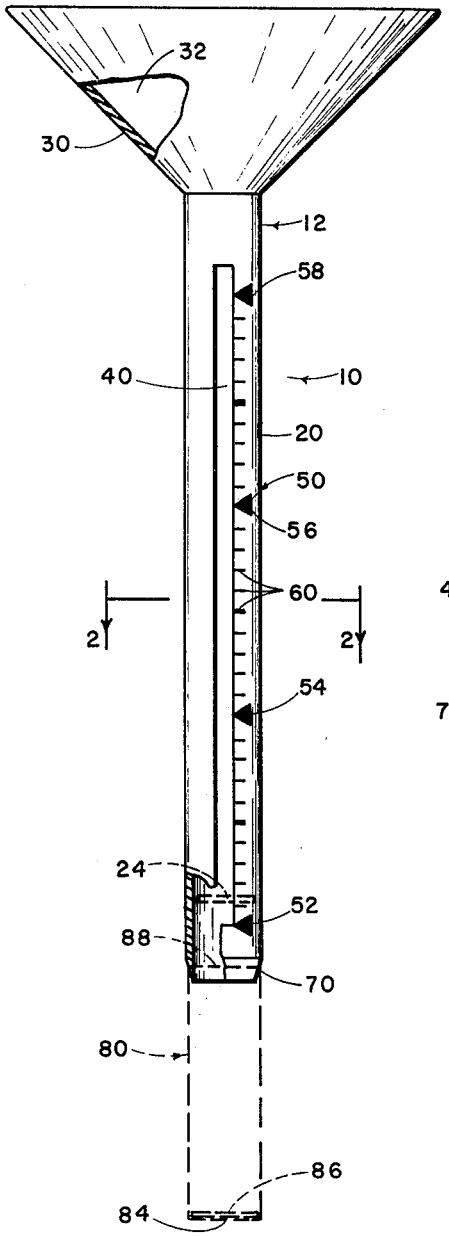
FIG. 1 is a side elevation of a coin counter and wrapper filler of this invention, shown with portions thereof removed and the other parts showing in section, a coin wrapper tube being as shown in dotted lines received on the lower end of the coin counter.
Figure 2:
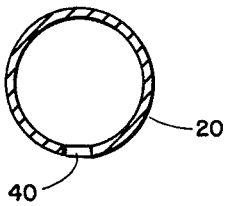
FIG. 2 is a sectional view, taken along the line 2—2 of FIG. 1.

The coin counter and wrapper filler of this invention is generally indicated at 10 in FIG. 1, and comprises a body 12, having a hollow upstanding shank 20, for receiving coins, one of which is shown in dotted lines at 24, to illustrate that coins are normally horizontally disposed in the hollow shank 20.

The body 12 has a funnel 30 at its upper end, having a hollow interior, which opens upwardly, shown at 32.

The shank has a coin visibility slot 40, extending vertically and completely through the vertical shank 20 from the exterior thereof to the interior, so that coins can be seen through the slot 40 in order to determine their height in the shank 20, so as to measure the quantity of coins against indicia, generally indicated at 50, and which can comprise major indicia 52, 54, 56 and 58, each representing a known quantity of coins, as determined by whether the coins are at the same level as the indicia.

In between the major indicia can be lesser indicia marks 60, which latter can be in any quantity or spacing in accordance with suitable coin measuring in accordance with thickness. The exact indicia position and spacing is a matter of suitability and indicia shown are only for purposes of illustration.

At the bottom of the shank 20 the cylindrical outer side thereof is tapered inwardly and downwardly toward the lower end so as to be easily insertable into the open upper end of a cylindrical coin wrapper 80, shown in dotted lines in FIG. 1, and which latter has its lower end closed at 84 by the folding in of end portions of the wrapper 80, so as to retain coins therein, such as a coin shown in dotted lines at 86 resting on the bottom 84 of the wrapper 80.

After a wrapper 80 is filled with coins then the uppermost part of the wrapper is folded in to form an upper wall so as to retain the coins in the usual manner.

The upper end 88 of the wrapper 80 is of an internal size to fit tightly against the beveled inclined surface 70 of the lower end of the shank 20.

Figure 3:
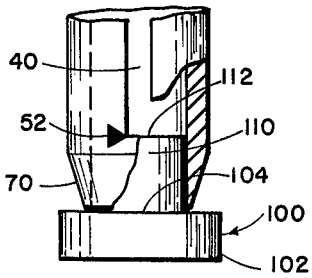
FIG. 3 is a detail of the hollow shank portion of a coin counter, with a plug therein, a part of the shank being broken away.

A plug 100 is shown in FIG. 3 with a lower portion 102, having an upper side 104 which extends across and engages the lower end of the shank 20.

The plug 100 has an upper end portion 110 of resilient nature which resiliently and removably grips the lower end of the shank 20 by insertion into the shank and by its pressure against the shank because of its resilience.

The plug 100 can be removed from the shank 20 after coin counting has been finished and for permitting coins to fall into the open top of the closed coin wrapper 80.

It is to be understood that during a counting of coins, the plug 100 is in place and the wrapper 80 is not in place, the coins being held in an operator's hand and allowed to fall into the funnel 30 until the coins have reached the desired quantity as measured by the indicia 50 and 60. It is desired that an indicia 54, for example, be at a position, such as to indicate the proper quantity of coins to fill the wrapper 80 shown in FIG. 1.

It is important that the uppermost end 112 of the plug 100 be at a position in the shank 20 which is exactly determined, so that as the coins pile up in the shank 20, the indicia 50 will read truely. For this reason the lowermost indicia 52, although it is not a necessary indicia, can serve to show a zero point directly opposite the upper end of the plug 100. It is from the zero point 52 that all other indicia measure quantities of coins.

Figure 4:
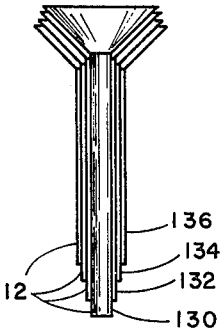
FIG. 4 is a diagrammatic view showing a plurality of the body portions of coin counters with the plugs removed and with progressively smaller body portions nested one inside another for compact storage. The innermost counter body is shown in full, outer counter bodies are shown with the closer half portions being broken away and the remainder showing in section.

Referring now to FIG. 4, it will be seen that counter bodies 12 of counters having shanks of various diameters are disposed one inside the other for convenient storage in compact space, at times when the plugs are removed therefrom, and the numerals 130, 132, 134 and 136 indicate various counters each with their shanks disposed progressively outwardly of the others.

We claim:

1. A coin counter and wrapper filler comprising a body having a hollow upstanding shank for receiving coins, said body having a funnel attached to its upper end and emptying into said shank, indicia on said shank for indicating the number of coins therein, said shank having visibility means so that the quantity of coins inside said shank can be read against indicia printed on said shank, and a plug having a portion extending across and engaging the lower end of said shank so as to prevent said plug from entering said shank beyond a desired point, said plug having an upper end portion of resilient nature which resiliently and removably grips the lower end of said shank whereby said plug can be removed after coin counting for permitting coins to fall into the open top of a closed coin wrapper, the lower end of said shank being tapered inwardly on its outer side for reception in the upper end of a paper coin wrapper, said wrapper being of a type which is cylindrical when fully expanded.

* * * * *